US011051666B2

(12) United States Patent
Albert et al.

(10) Patent No.: US 11,051,666 B2
(45) Date of Patent: Jul. 6, 2021

(54) PRE-MOISTENED WIPE PACKAGE WITH APPLICATOR

(71) Applicant: Tactopack, Inc., Pelham, NY (US)

(72) Inventors: Jonathan D. Albert, Philadelphia, PA (US); Steven Bank, Pelham, NY (US)

(73) Assignee: TACTOPACK, INC., Pelham, NY (US)

( * ) Notice: Subject to any disclaimer, the term of this patent is extended or adjusted under 35 U.S.C. 154(b) by 0 days.

(21) Appl. No.: 16/126,801

(22) Filed: Sep. 10, 2018

(65) Prior Publication Data

US 2019/0075981 A1 Mar. 14, 2019

Related U.S. Application Data

(60) Provisional application No. 62/556,746, filed on Sep. 11, 2017.

(51) Int. Cl.

| | |
|---|---|
| ***A47K 10/42*** | (2006.01) |
| ***A47L 13/17*** | (2006.01) |
| *A47K 10/32* | (2006.01) |

(52) U.S. Cl.

CPC ..... *A47K 10/421* (2013.01); *A47L 13/17* (2013.01); *A47K 2010/3266* (2013.01)

(58) Field of Classification Search

CPC ..... A47K 10/46; A47K 10/421; A47K 2010/3266; A47L 13/17; B29C 43/18; B65D 83/0805; B65D 25/005

See application file for complete search history.

(56) References Cited

U.S. PATENT DOCUMENTS

| | | | | |
|---|---|---|---|---|
| 19,188 | A | 1/1858 | Evans | |
| 674,913 | A * | 5/1901 | Fike | A47L 13/19 401/7 |
| 685,574 | A | 10/1901 | Conboie | |
| 722,863 | A | 3/1903 | Lodge | |
| 836,181 | A | 11/1906 | Cray | |
| 1,161,719 | A | 11/1915 | Norton | |
| 1,438,485 | A | 12/1922 | Goldberg | |
| 1,481,772 | A | 1/1924 | Zell | |

(Continued)

FOREIGN PATENT DOCUMENTS

| | | | |
|---|---|---|---|
| CH | 303374 | A | 11/1954 |
| EP | 2676544 | A1 | 12/2013 |

(Continued)

*Primary Examiner* — Gene O Crawford
*Assistant Examiner* — Kelvin L Randll, Jr.
(74) *Attorney, Agent, or Firm* — Leason Ellis LLP

(57) ABSTRACT

A pre-moistened wipe package with applicator includes a multi-ply applicator body that defines a first interior space between a first layer and a second layer and a second interior space between the second layer and a third layer. The first layer has an opening that is open to an exterior and provides access to the first interior space with a lid member being coupled to the first layer and configured to cover the opening in a closed position thereof. The second interior space is configured to receive a hand of a user. The package also includes an arrangement of wipes disposed within the first interior space and being removable through the opening. An outer exposed surface of the third layer is configured so as to releasably hold one of the wipes along the outer exposed surface.

15 Claims, 12 Drawing Sheets

(56) References Cited

U.S. PATENT DOCUMENTS 1,533,732 A 4/1925 Livingstone
1,558,930 A 10/1925 Schuck
1,619,180 A 3/1927 Andrew
1,713,065 A 5/1929 Williams
1,941,320 A 12/1933 Pamplin
2,075,413 A 3/1937 Logue
2,405,154 A 8/1946 Logan
2,562,418 A 7/1951 Enrico et al.
2,651,071 A * 9/1953 Frances ..... A47L 13/18 15/227
2,722,706 A 11/1955 Joan
2,795,806 A 6/1957 Omar
2,831,206 A 4/1958 Curtis
3,116,732 A 1/1964 Cahill
3,485,562 A 12/1969 Hidden et al.
3,589,819 A 6/1971 Bryant
3,701,604 A 10/1972 Holroyd
3,778,172 A 12/1973 Myren
3,883,897 A * 5/1975 Lefkowitz ..... A41D 19/01594 2/161.6
3,885,249 A 5/1975 De Brabander
4,037,790 A 7/1977 Reiser et al.
4,088,127 A * 5/1978 Clayton ..... A61F 7/02 601/134
4,156,493 A * 5/1979 Julius ..... B65D 83/0805 206/494
4,349,288 A * 9/1982 Bond ..... A47K 7/08 401/26
4,457,640 A 7/1984 Anderson
4,602,650 A 7/1986 Pipkin
4,645,251 A 2/1987 Jacobs
D290,777 S * 7/1987 Lee ..... D32/40
4,766,914 A 8/1988 Briggs
4,805,242 A * 2/1989 Bolton ..... A41D 19/002 2/160
4,953,998 A 9/1990 McCartherens
4,959,881 A 10/1990 Murray
5,094,559 A 3/1992 Rivera et al.
5,111,934 A 5/1992 Morin
5,120,304 A 6/1992 Sasaki
5,169,251 A 12/1992 Davis
5,441,355 A 8/1995 Moore
5,456,354 A 10/1995 Wood
5,473,789 A 12/1995 Oster
5,542,566 A * 8/1996 Glaug ..... B65D 83/0805 221/48
5,722,349 A 3/1998 Wolgamuth
5,732,716 A * 3/1998 Utecht ..... A61B 42/10 128/898
5,806,668 A * 9/1998 Bixby ..... A41D 19/0068 15/227
5,867,829 A 2/1999 Hegoas et al.
5,947,275 A 9/1999 Hess
5,956,770 A * 9/1999 Dennis ..... A47L 13/18 15/227
6,098,234 A * 8/2000 Jackson, Jr. ..... A47K 7/02 15/104.94
6,145,155 A 11/2000 James et al.
6,168,019 B1 * 1/2001 Olson ..... A41D 19/0075 206/278
6,257,785 B1 7/2001 Otten
6,280,529 B1 * 8/2001 Meyer ..... A41D 19/01594 134/6
6,305,044 B1 * 10/2001 James ..... A47L 13/19 15/104.94
6,508,602 B1 1/2003 Gruenbacher et al.
6,513,998 B1 2/2003 Barry
6,539,549 B1 4/2003 Peters, Jr.
6,547,468 B2 4/2003 Gruenbacher et al.
6,554,134 B1 * 4/2003 Guibert ..... B65D 75/5838 206/494
6,557,178 B1 * 5/2003 Hoover ..... A41D 19/01594 15/227
6,588,961 B2 7/2003 Lafosse-marin et al.
6,604,244 B1 8/2003 Leach
6,669,387 B2 12/2003 Gruenbacher et al.
6,726,386 B1 4/2004 Gruenbacher et al.
6,811,338 B1 11/2004 Manske, Jr. et al.
6,817,801 B1 11/2004 Colburn et al.
6,834,619 B1 12/2004 Rampersad
7,021,848 B1 4/2006 Gruenbacher et al.
7,033,100 B2 4/2006 Barton et al.
7,108,440 B1 9/2006 Gruenbacher et al.
7,179,007 B2 2/2007 Wong et al.
7,255,506 B2 8/2007 Gruenbacher et al.
7,478,768 B2 1/2009 Yip
7,604,623 B2 10/2009 Brunner et al.
7,730,574 B1 6/2010 Cox, Sr.
7,731,056 B2 6/2010 Tramontina
7,823,245 B2 11/2010 Firouzman
7,874,020 B1 * 1/2011 Franklin ..... A47L 13/18 15/229.11
7,904,969 B2 3/2011 Greenfield
8,061,558 B2 11/2011 Jordan et al.
8,069,526 B2 12/2011 Malaska
8,167,177 B1 5/2012 Galgano
8,230,523 B2 7/2012 Chareyron
8,262,305 B2 9/2012 Lam et al.
8,356,378 B1 1/2013 Crooms
8,661,601 B2 3/2014 Klingbeil
8,689,387 B2 4/2014 Gundersen
8,776,268 B2 * 7/2014 Rodgers ..... A41D 19/002 2/158
8,794,189 B1 8/2014 Dahlquist et al.
8,826,467 B2 9/2014 Chew et al.
9,326,645 B1 5/2016 Bank et al.
9,808,130 B2 11/2017 Bank et al.
10,039,424 B2 8/2018 Bank et al.
10,219,657 B2 * 3/2019 Albert ..... A47K 5/1201
2002/0118993 A1 8/2002 Lafosse-Marin et al.
2005/0217045 A1 10/2005 Minkler et al.
2006/0064830 A1 * 3/2006 Sigi ..... A47L 13/17 15/104.94
2006/0230559 A1 * 10/2006 Knopow ..... A47L 13/18 15/104.002
2006/0288954 A1 12/2006 Graunstadt
2007/0094766 A1 5/2007 Liu
2007/0130707 A1 6/2007 Cohen et al.
2007/0192975 A1 8/2007 Aseff
2007/0206984 A1 9/2007 Fagel et al.
2008/0078046 A1 4/2008 Reed
2008/0276395 A1 11/2008 Powell et al.
2010/0037413 A1 2/2010 Tyler
2010/0218326 A1 9/2010 Yamaguchi
2010/0257681 A1 10/2010 Lin
2011/0113528 A1 5/2011 Chew et al.
2011/0240760 A1 10/2011 Tucker
2011/0274377 A1 * 11/2011 Lin ..... A47K 7/03 383/105
2012/0051828 A1 3/2012 Gundersen
2012/0090121 A1 4/2012 Phillips, Sr. et al.
2012/0189371 A1 7/2012 Morelli
2013/0341212 A1 12/2013 Perelli
2016/0000293 A1 * 1/2016 Povitz ..... A47L 13/19 134/7
2016/0287032 A1 10/2016 Bank et al.
2017/0238770 A1 * 8/2017 Albert ..... A47K 5/1201
2019/0261819 A1 * 8/2019 Albert ..... A47K 7/03

FOREIGN PATENT DOCUMENTS

FR 1127965 A 12/1956
FR 1539481 A 9/1968
GB 924503 A 4/1963
JP 2001269222 A 10/2001
WO WO 2004/100735 11/2004
WO WO 2006120330 11/2006
WO WO 2007122594 11/2007
WO WO 2008096135 8/2008

* cited by examiner

PRE-MOISTENED WIPE PACKAGE WITH APPLICATOR

CROSS REFERENCE TO RELATED APPLICATIONS

The present application is based on and claims priority to 62/556,746, filed Sep. 11, 2017, and is related to U.S. application Ser. No. 14/677,532, filed Apr. 2, 2015, now U.S. Pat. No. 9,326,645, issued May 3, 2016, U.S. application Ser. No. 15/084,174, filed Mar. 29, 2016, now U.S. Pat. No. 9,808,130, issued Nov. 7, 2017, and U.S. application Ser. No. 15/294,204, filed Oct. 14, 2016, now U.S. Pat. No. 10,039,424, issued Aug. 7, 2018, and U.S. application Ser. No. 15/449,265, filed Mar. 3, 2017, each of which is hereby incorporated by reference in its entirety.

TECHNICAL FIELD

A functional package is described in which a pre-moistened wipe is supported during use by an integral applicator that provides a barrier to protect the wearer from the wet wipe during usage.

BACKGROUND

Pre-moistened wipes or wet wipes are typically packaged in a package style called a flow wrapper. A flow wrapper is a single piece of flexible packaging material that is first heat sealed along the continuous length to produce a tube. This first seal is called the fin seal. Subsequently, the ends are sealed on both ends to form a closed package. This is typically done in a continuous process in which a stack of pre-moistened wipes is moved along a belt and the flow wrapper is formed around the stack. The user accesses the pre-moistened wipes through a resealable flap or plastic re-closeable lid that is glued to the outside of the package. FIGS. 1-3 show examples of traditional packaging. FIG. 1 shows a traditional forming process 20 that includes introduction of a stack of wipes 21 that are introduced into a film forming station 22 at which a sealing film 23 is provided on both sides of the stack of wipes 21. The stack of wipes 21 is sandwiched between the sealing film 23 and fed to a sealing station 24 where the stack of wipes 21 are sealed to form a completed wipe product 50. Once sealed, the formed product is then discharged along a conveyor and delivered to another location. FIG. 2 shows the completed wipe product 50 that is sealed package in which the stack of wipes 21 are sealed and can be accessed through a releasable flap 55. FIGS. 3A and 3B show a completed wipe product 60 that is similar to the completed wipe product 50 that includes the stack of wipes 21 with the exception that a foldable cover 65 is provided to either open or close the opening that provide access to the wipes 21.

SUMMARY

The present invention is directed to packaging for wet wipes in which there is an additional feature of providing an application tool for the wipe. The package consists of three layers, where the wipes are packaged between the top and middle layers and an opening for a user's hand or fingers is formed between the middle layer and bottom layer. This additional functionality lets the user remove a wipe from the package and then use the same package to use the wipe to clean or apply fluid to surfaces. The bottom layer provides a barrier between the hand and the wipe and provides a flat surface that holds the wipe in a flattened state to provide better use of the entire area of the wipe. This bottom layer also permits the use of thinner, more fragile wipes which can permit lower cost wipes or flushable wipes to be used in more aggressive cleaning applications.

Although this invention is primarily intended for use with wet wipes, it can be used for dry wipes. It can also be used in a system where the wipes are shipped in a dry state, but an enclosed rupturable packet moistens the wipes before use.

BRIEF DESCRIPTION OF THE DRAWING FIGURES

DETAILED DESCRIPTION OF CERTAIN EMBODIMENTS

Figure 4:
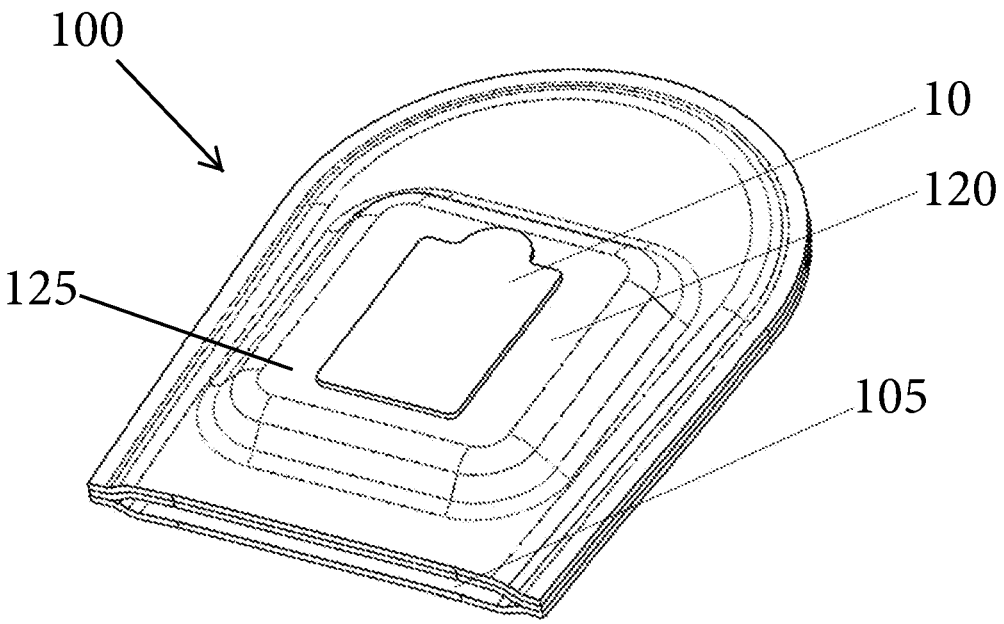
FIG. 4 is a top perspective view of a pre-moistened wipe package with applicator.

FIG. 4 shows an overall assembly 100 shown in a mitt or whole hand shape in a perspective view and in particular, the assembly 100 is in the form of a pre-moistened wipe packaging with applicator. The packaging 100 includes a lid 110 that is attached to a top surface 125 of a top layer 120. An opening 123 is formed in the top layer 120 and is for reception of the hand or fingers to permit access to a stack or roll of wipes 10. In FIG. 4, an interior space is shown at 105 and is configured to receive the hand. The top layer 120 is shown for clarity of illustration as having a bulge 121, but this bulge may or may not be present in the packaging 100 depending on the size and thickness of the stack or roll of wipes 10 that is housed in the assembly.

Figure 1:
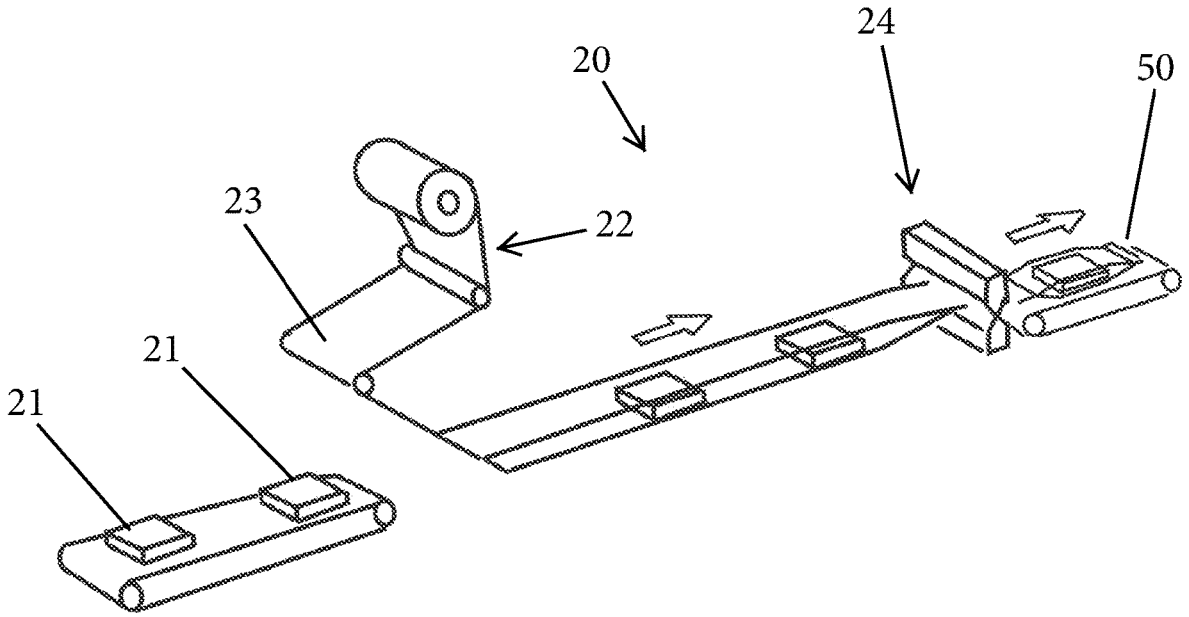
Fig. 1 (Prior Art)
FIG. 1 is a perspective view of a conventional process for manufacturing a pre-moistened wipe product.
Figure 2:
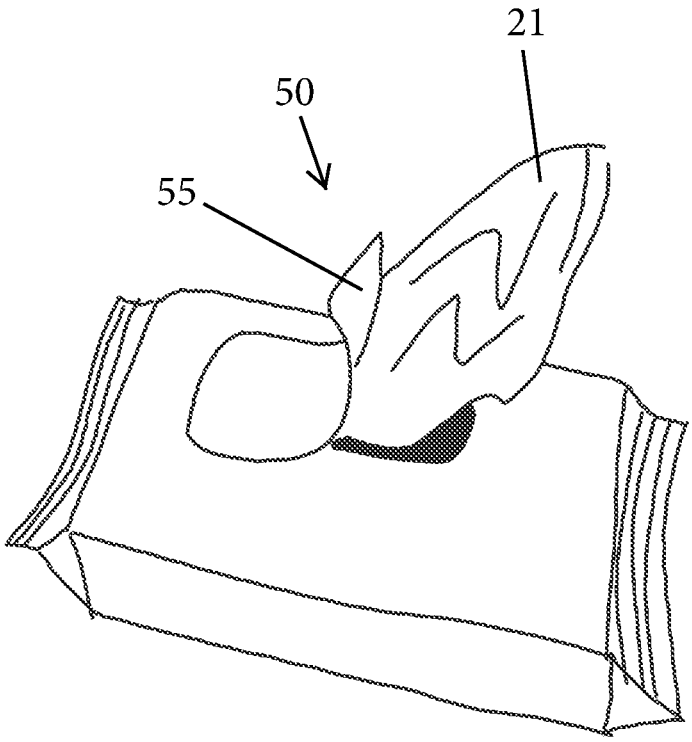
Fig. 2 (Prior Art)
FIG. 2 is a perspective view of the completed pre-moistened wipe product with a resealable flap being open.
Figure 3A:
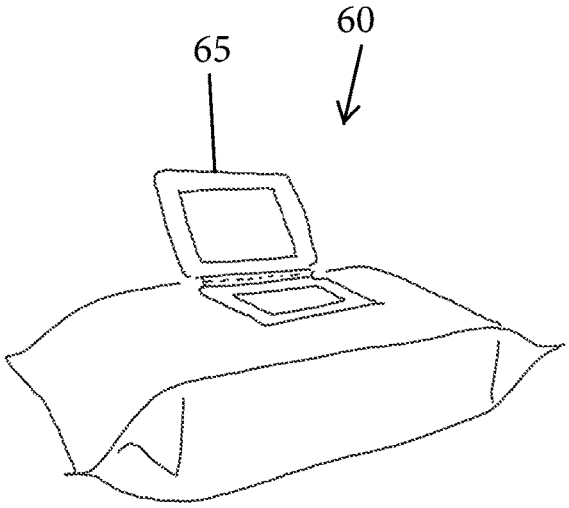
FIGS. 3A and 3B show a pre-moistened wipe product with a movable cover shown in an open position (FIG. 3A) and closed position (FIG. 3B)
Figure 3B:
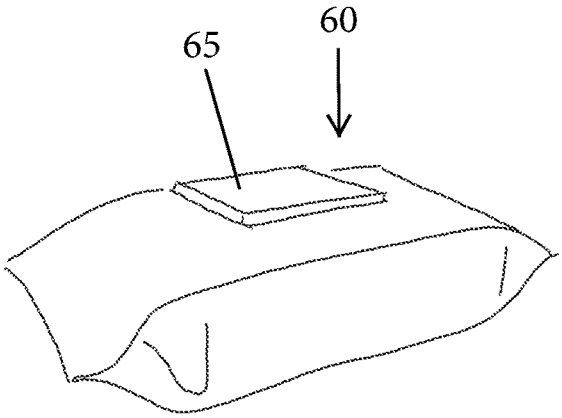
Fig. 3B (Prior Art)
Figure 5:
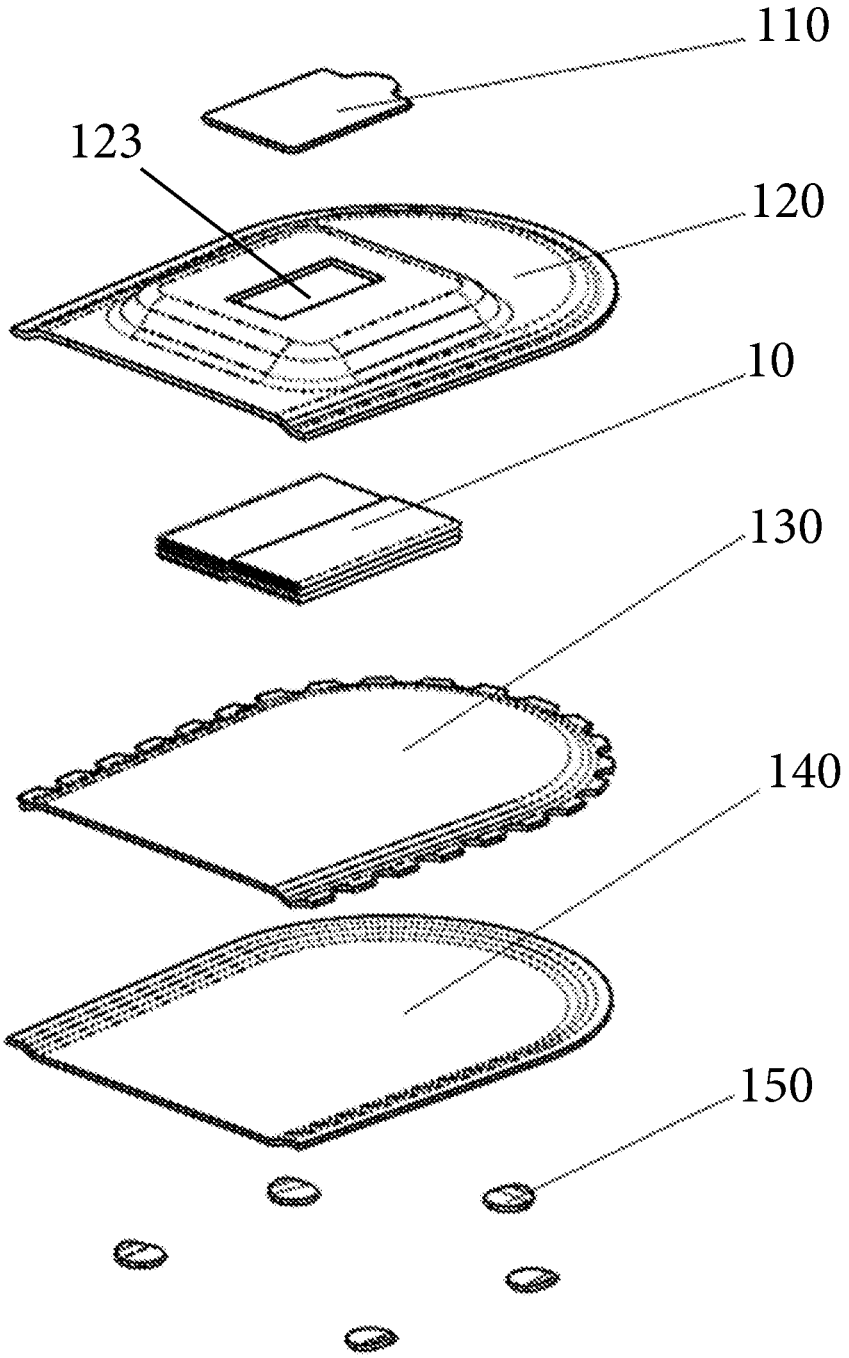
FIG. 5 is an exploded perspective view thereof.

FIG. 5 shows an exploded view of the packaging 100. The lid 110 can be a plastic film or a molded part with a snap retaining window or any other structure used as a lid in traditional packaging wet wipes (FIGS. 1-3). The top layer 120 can be made of a flexible packing material, typically a laminate consisting of polyethylene terephthalate (PET) and a polyethylene heat seal layer and an optional barrier such as aluminum to increase shelf life. The wipes 10 are a stack or roll of pre-moistened wipes and may be interleaved to make removing a single wipe easier through the lid 120. Opening 123 in the top layer 120 is shown.

The packaging 100 also includes a middle layer 130 can be made of the same material as the top layer 120, but the heat seal layer is facing up as shown in this drawing. This is such that a heat seal layer (e.g., an underside) of the top layer 120 and the middle layer 130 will bond together and form a pouch during the manufacture of the product (packaging 100). This pouch located between the top layer 120 and the middle layer 130 receives and contains the wipes 10. As shown, the pouch can be defined by a locally raised portion of the top layer 120 and the top surface of the middle layer 130. The surrounding portion of the top layer 120 that surrounds the locally raised portion 121 of the top layer 120 seats directly against and seals against the top surface of the middle layer 130.

The packaging 100 includes a bottom layer 140 can be made of plastic or foam or any other suitable layer that provides isolation between the hand and the wipe during use. In particular, the interior space 105 is formed between the middle layer 130 and the bottom layer 140 and the user's hand or fingers are received within this space 105 to allow the user to wear the packaging 100 as a mitt. The middle layer 130 thus separates the user's hand and the wipes 10.

Figure 6:
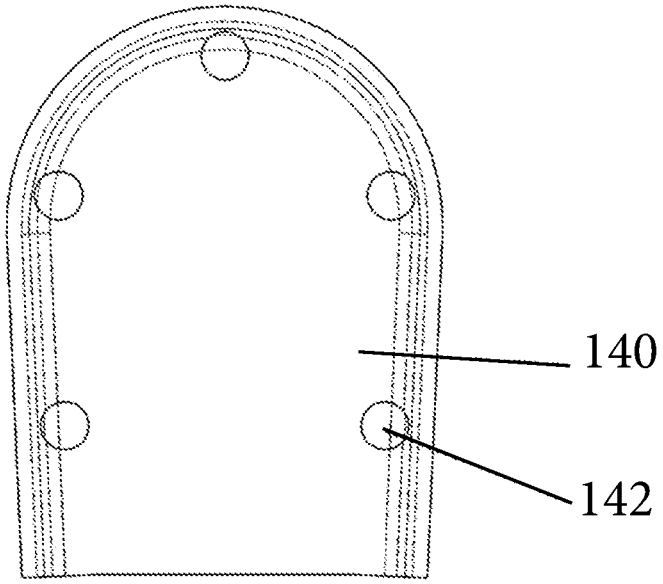
FIG. 6 is a bottom plan view of a bottom layer of the pre-moistened wipe package with applicator.

As shown in FIGS. 5 and 6, the bottom layer 140 can include one or more and preferably a plurality of fasteners 150. In the illustrated embodiment, the fasteners 150 are in the form of a plurality of hook fasteners that have small hooks intended to grip non-wovens (such as a wipe 10). For example, these hooks could be die cut from Velcro® brand part number 847. FIG. 6 is a bottom view of the applicator 100. The hook fasteners 150 are arranged on bottom layer 140 to provide sufficient attachment points to keep the wipe 10 spread out and prevent it from moving during application or cleaning tasks. Hooks 150 can be separate parts that are attached to bottom layer 140 using adhesive, such as a hot melt adhesive or pressure sensitive adhesive. Alternatively, the hooks 150 can be directly incorporated into a plastic part during injection molding. Combining the bottom layer 140 and hook fasteners 150 into a single, integral part would reduce the cost of the assembly 100.

Figure 7:
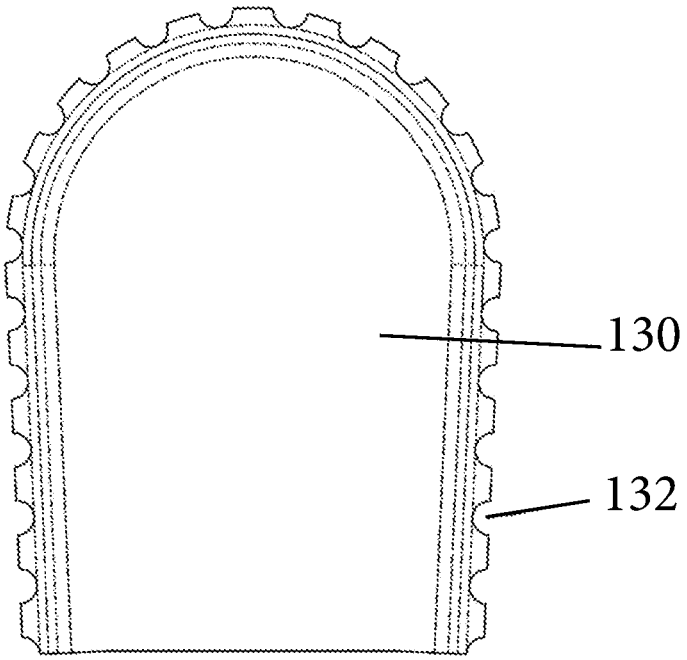
FIG. 7 is a top plan view of a middle layer of the pre-moistened wipe package with applicator.

FIG. 7 shows the middle layer 130 without the other components. An array of cuts or notches 132 are formed around the perimeter and provides a means to allowing the heat seal layer (the underside) from the top layer 120 to be exposed after the top layer 120 and the middle layer 130 are bonded together. These exposed areas allow the bottom layer 140 to be adhered to the construction without additional adhesives and provide a low cost method of assembly. More particular, the underside bonding (heat seal) layer of the top layer 120 is accessible through the cuts 132 of the middle layer 130 and can contact the top layer of the bottom layer 140. This method is described in Applicant's previous application US 2017/0238770, which has been previously incorporated by reference herein. These cuts 132 can be circular, oblong, or any other shape that provides an aperture in the middle layer 130 to provide bonding between the top layer 120 and the bottom layer 140 (FIG. 5). Alternatively, an adhesive may be used, or a plastic part could be retained using heat staked posts or some other mechanical means of attachment.

Figure 8:
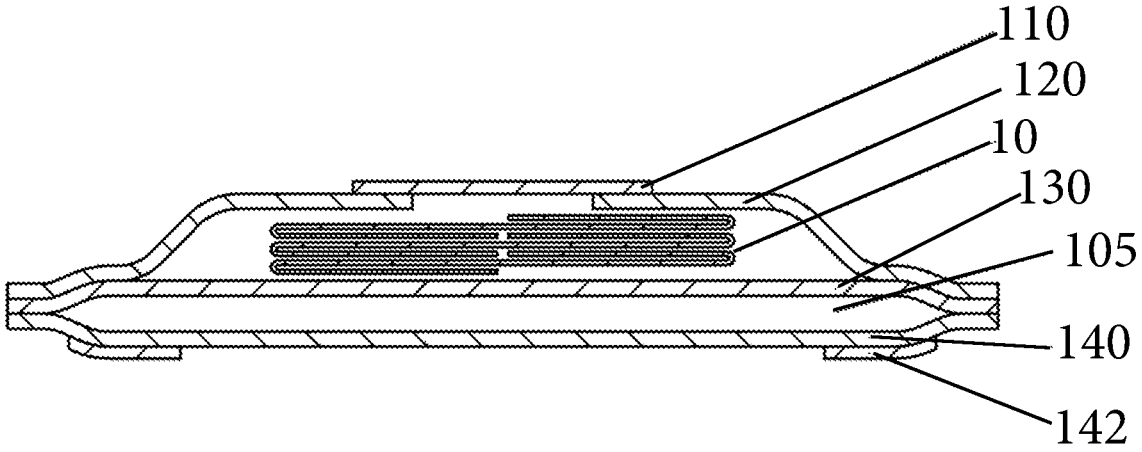
FIG. 8 is a cross-sectional view of the pre-moistened wipe package with applicator.

FIG. 8 shows a cross section of the assembly 100. The lid 110 is attached to the top layer 120 and an aperture 123 in the top layer 120 allows access to the pre-moistened wipes 10. Middle layer 140 completes the enclosing package for the wipes 10. The hand opening 105 is created between middle layer 130 and bottom layer 140. Hook fasteners 150 are arrayed on the bottom surface on the bottom layer 140.

Figure 9:
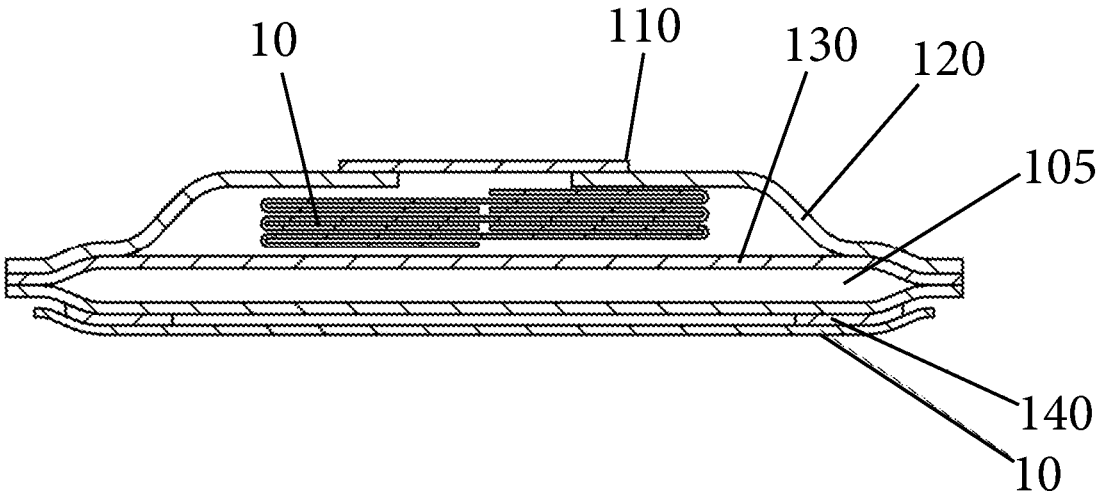
FIG. 9 is a cross-sectional view of the pre-moistened wipe package with applicator with a wipe attached along the bottom layer.

FIG. 9 shows the assembly 100 where a wipe 10 has been adhered to hook fasteners 150 (FIG. 6) during use. The wipe 10 covers a sufficient area to allow cleaning, scrubbing, or fluid application tasks. It does not need to cover the entirety of the bottom layer 140.

Figure 10:
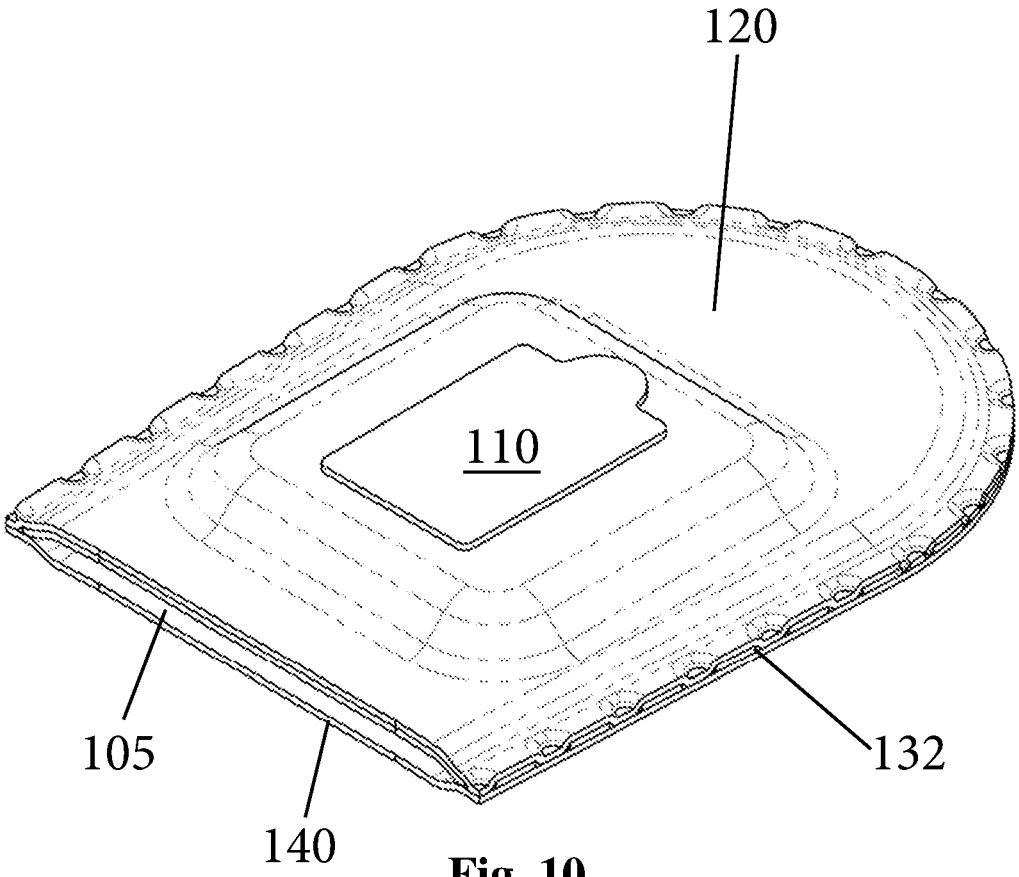
FIG. 10 is a perspective view showing an array of cuts in the middle layer that allow the top layer to adhere to the bottom layer.

FIG. 10 shows how the array of cuts 132 allow the top layer 120 to adhere to the bottom layer 140. The cuts 132 are voids in the middle layer 130, thereby allowing direct overlying contact between the top layer 120 and the bottom layer 140. This arrangement allows a direct heat seal to be formed between the top layer 120 and the bottom layer 140. The shapes and sizes of the cuts 132 can vary.

Figure 11:
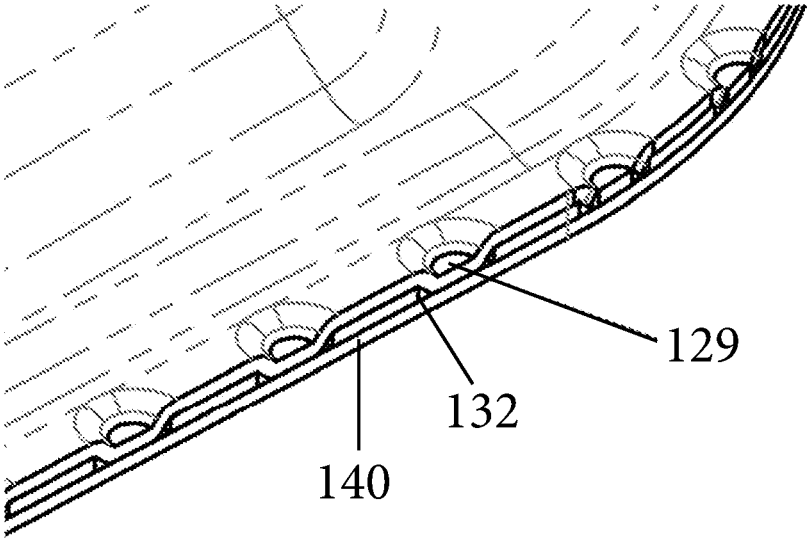
FIG. 11 is a close-up of a portion of the pre-moistened wipe package with applicator showing the top layer adhered to the bottom layer through the array of cuts formed in the middle layer.

FIG. 11 shows a detail view of this where a region 129 of the top layer 120 can protrude through the holes (cuts 132) in the middle layer 130.

Figure 12:
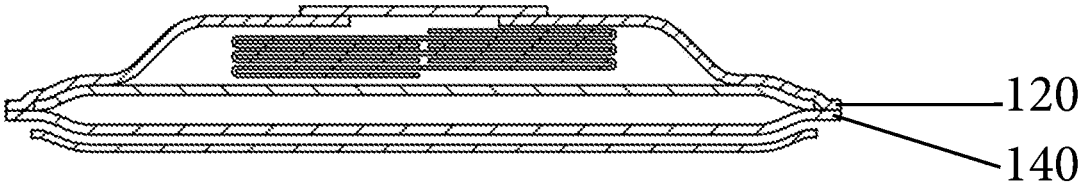
FIG. 12 is a cross-sectional view showing the top layer touching the bottom layer through the notched openings (cuts) formed in the middle layer.

FIG. 12 shows a cross section of this detail where it is shown that the top layer 110 is touching the bottom layer 140 through the notched openings (cuts) 132.

It will be appreciated that an alternative use for product 100 is to use gloves or a standalone applicator.

It would also be possible to invert the structure (packaging 100) such that during use, the pouch for the wipes would be between the user's hand and the surface.

In one embodiment, between 10 and 30 wipes can be provided as the stack 10 and contained and held within the interior of the packaging 100.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A pre-moistened wipe package with applicator comprising:

a multi-ply applicator body that defines a first interior space between a first layer and a second layer and a second interior space between the second layer and a third layer, wherein the first layer has an opening that is open to an exterior and provides access to the first interior space with a lid member being coupled to the first layer and configured to cover the opening in a closed position thereof, the second interior space being configured to receive a hand of a user; and an arrangement of wipes disposed within the first interior space and being removable through the opening;

wherein an outer exposed surface of the third layer is configured so as to releasably hold one of the wipes along the outer exposed surface;

wherein the second layer has a plurality of open peripheral notches formed along a peripheral edge thereof so as to provide direct access points between the first layer and a third layer, wherein the first and third layers are directly attached to one another at locations that lie within the peripheral notches of the second layer.

2. The pre-moistened wipe package with applicator of claim 1, wherein the first layer is a rear layer, the second layer is a middle layer, and the third layer is a front layer.

3. The pre-moistened wipe package with applicator of claim 1, wherein the first layer has a raised portion to accommodate a thickness of the arrangement of wipes and the opening is formed in the raised portion.

4. The pre-moistened wipe package with applicator of claim 3, wherein the lid member is disposed along the raised portion.

5. The pre-moistened wipe package with applicator of claim 3, wherein the first layer includes a surrounding portion that surrounds the raised portion, the surrounding portion being directly seated against and sealed to an upper surface of the second layer with the raised portion not being sealed to the upper surface but instead spaced therefrom.

6. The pre-moistened wipe package with applicator of claim 1, wherein the outer exposed surface of the third layer includes hook fasteners and each wipe is a non-woven.

7. The pre-moistened wipe package with applicator of claim 1, wherein one edge of the lid member is hingedly attached to the top surface of the top layer.

8. The pre-moistened wipe package with applicator of claim 1, wherein the second interior space has a greater area than the first interior space.

9. The pre-moistened wipe package with applicator of claim 1, wherein the multi-ply applicator body has a curved edge at a first end and the second interior space is open along an opposite second end for receiving the hand of the user.

10. The pre-moistened wipe package with applicator of claim 9, wherein the opening to the first interior space is located between the first end and the second end and faces away from the second layer.

11. The pre-moistened wipe package with applicator of claim 1, wherein a peripheral edge of the first layer and the third layer overlie one another, while a peripheral edge of the second layer only partially overlaps each of the first layer and the third layer.

12. The pre-moistened wipe package with applicator of claim 1, wherein the outer exposed surface of the third layer includes a plurality of fasteners spaced apart from one another and configured so as to releasably hold one of the wipes along the outer exposed surface.

13. The pre-moistened wipe package with applicator of claim 12, wherein the plurality of fasteners comprises hook material patches.

14. The pre-moistened wipe package with applicator of claim 1, wherein the first interior space is completely sealed from the second interior space.

15. A pre-moistened wipe package with applicator comprising:

a multi-ply applicator body that defines a first interior space between a first layer and a second layer and a second interior space between the second layer and a third layer, wherein the first layer has an opening that is open to an exterior and provides access to the first interior space with a lid member being coupled to the first layer and configured to cover the opening in a closed position thereof, the second interior space being configured to receive a hand of a user; and an arrangement of wipes disposed within the first interior space and being removable through the opening;

wherein an outer exposed surface of the third layer is configured so as to releasably hold one of the wipes along the outer exposed surface;

wherein a peripheral edge of the first layer and the third layer overlie one another, while a peripheral edge of the second layer only partially overlaps each of the first layer and the third layer;

wherein the peripheral edge of the second layer has a series of notches formed therein wherein within each notch the first layer overlies the third layer.

* * * * *